United States Patent [19]

Iles

[11] Patent Number: 4,473,342

[45] Date of Patent: Sep. 25, 1984

[54] PERISTALTIC PUMPING DEVICE

[75] Inventor: Frank Iles, Cornwall, England

[73] Assignee: Autoclude Limited, Cornwall, England

[21] Appl. No.: 416,559

[22] Filed: Sep. 10, 1982

[30] Foreign Application Priority Data

Oct. 7, 1981 [GB] United Kingdom ..... 8130326

[51] Int. Cl.[3] ..... F24B 43/12; F24B 17/00

[52] U.S. Cl. ..... 417/360; 417/475; 417/477

[58] Field of Search ..... 417/475, 477, 412, 360

[56] References Cited

U.S. PATENT DOCUMENTS

| | | | |
|---|---|---|---|
| 1,723,227 | 8/1929 | Xippas | 417/360 |
| 2,893,324 | 7/1959 | Isreeli et al. | 417/477 |
| 4,211,519 | 7/1980 | Hogan | 417/475 |
| 4,233,001 | 11/1980 | Schmid | 417/475 |
| 4,289,459 | 9/1981 | Neeley | 417/475 |

FOREIGN PATENT DOCUMENTS 1578022 10/1980 United Kingdom .

*Primary Examiner*—Richard E. Gluck
*Attorney, Agent, or Firm*—Stefan J. Klauber

[57] ABSTRACT

A peristaltic pumping device comprises a cartridge which is releasably engagable in a circular socket of a peristaltic pump. The cartridge has a carrier having an annular series of peripheral rollers, the carrier being rotated by an output rotary assembly of the pump through a drive shaft. A plurality of tubes are located to pass through the cartridge in engagement with the rollers which effect pumping of liquids through the tubes by compression of successive parts of the tubes by the rollers as the carrier rotates thereby inducing the liquid flows therethrough by peristaltic action.

19 Claims, 9 Drawing Figures

FIG. 3A
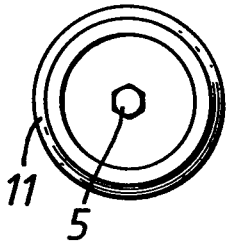
FIG. 3B
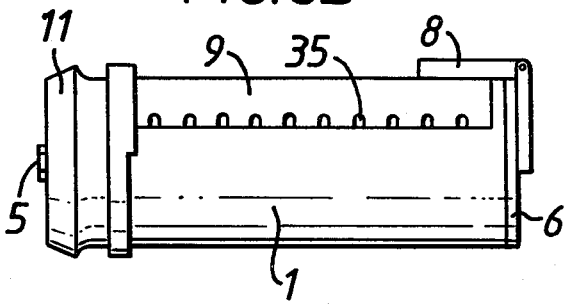
FIG. 6
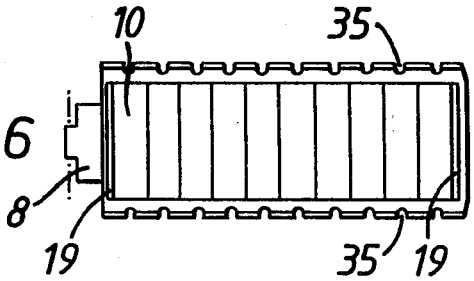
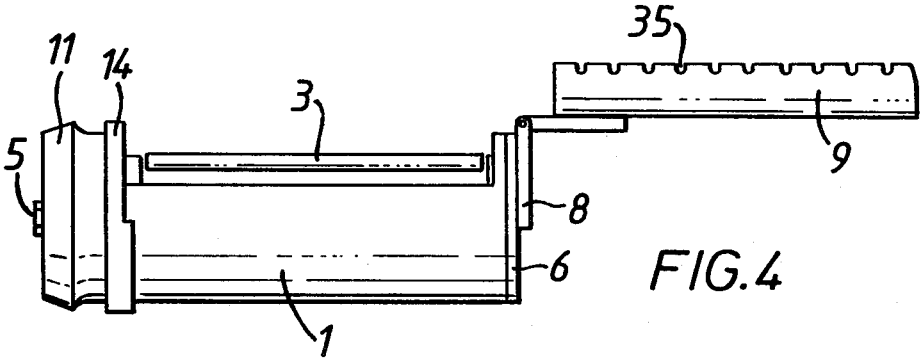
FIG. 4
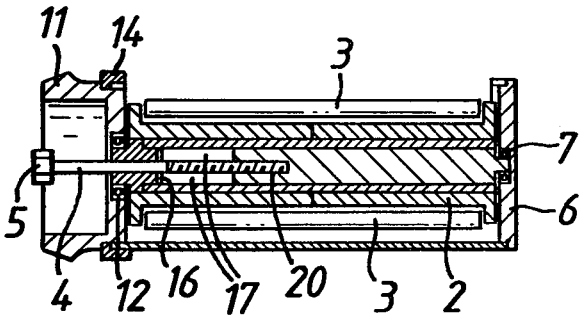
FIG. 5

PERISTALTIC PUMPING DEVICE

FIELD AND BACKGROUND OF THE INVENTION

The invention relates to a peristaltic pumping device.

Peristaltic pumps have been widely used for medical applications whereby a fluid is delivered through a single compressible tube at a controlled rate. British Patent Specification No. 1,578,022 describes such a peristaltic pump in which the flexible walled tube is contained in a cartridge which can be plugged into an open mouthed chamber in the pump housing to allow easy loading and unloading of the tube in the pump. However, there are many possible applications where peristaltic pumps could be used to provide a flow of fluid by peristaltic action through a plurality of separate fluid lines, e.g. dosaging and sampling blood analysis, chromatography analysis, general laboratory pumping, etc.

SUMMARY OF THE INVENTION

According to the invention, there is provided a peristaltic pumping device comprising a housing, rotor means rotatably mounted in the housing, and means for locating a plurality of flexible walled tubes to extend through the housing and at least part way around the rotor means at respective positions axially along the rotor means such that the rotor means, when rotated in use, act on the tubes to compress successive parts thereof against support means provided on or by the housing thereby inducing a flow of fluid through the tubes by peristaltic action.

In some constructions according to the invention, said locating means may be adapted to locate a plurality of tubes, in use, such that they extend only part way around the rotor means. In such constructions, the rotor means may comprise a plurality of circumferentially spaced members arranged so that, in use, at least one such member is in engagement with each tube at any angular position of the rotor means. The rotor means may comprise a plurality of freely rotatable rollers arranged in an annular series which is coaxial with the axis of rotation of the rotor means, for engagement with a plurality of tubes located in use in the housing.

Said locating means may comprise a wall portion of the housing which is movably mounted thereon to allow positioning of a plurality of tubes in the device and means to lock the wall portion in its "closed" position in the housing wall. The housing may comprise a tubular wall surrounding the rotor means, said wall portion being an arcuate section of that tubular wall. The arcuate wall portion may be hingedly mounted on the housing at one axial end of the arcuate wall portion. Said locking means may comprise a ring rotatably mounted on the housing and having an arcuate axially projecting flange adapted to overlie a portion of said arcuate wall portion at the free end thereof in particular angular positions of the ring thereby to lock the wall portion in its "closed" position in the housing wall.

Said arcuate wall portion may be provided with pairs of aligned notches in its axial edges at spaced locations therealong whereby a plurality of flexible walled tubes can be engaged in respective pairs of notches with the wall portion in an open position whereby the tubes are brought into engagement with the rotor means when the wall portion is moved into its closed position. Said support means may be provided by a plurality of curved track members mounted on the inner surface of the arcuate wall portion. The track members are preferably resiliently mounted on said wall portion to accommodate flexible walled tubes of different bore sizes. Each curved track member may be pivotally mounted at or adjacent one end thereof on said wall portion with spring means, e.g. a leaf spring, being located to act between the wall portion and the track member at a position spaced from its pivot.

In some embodiments of the invention, said peristaltic pumping device may be in the form of a cartridge adapted to be releasably engaged with a separate rotary drive means incorporating a prime mover. In other constructions a prime mover may form an integral part of the pumping device.

In a preferred embodiment the cartridge may be adapted to cooperate with a peristaltic pump comprising a body having an open mouthed chamber, a rotary device mounted in the body for rotation in the chamber about an axis, and means to rotate the rotary device, wherein an end portion of the cartridge is adapted to be releasably mounted in the chamber through the open mouth thereof and releasable drive coupling means are provided to form a rotary drive connection between said rotor means and said rotary device on engagement of said end portion of the cartridge in said chamber. Said rotary drive connection may include a shaft projecting axially from the rotor means and fixed against rotation with respect thereto, the shaft having a head portion adapted to engage in a recess in an end face of the rotary device and the head portion and the recess being shaped to form a rotary drive connection therebetween. Said shaft may be slideably mounted in a bore in the rotor means for linear movement relative thereto and it may be resiliently biased to a position in which it projects axially beyond the end of the cartridge to facilitate engagement of said head portion in said recess.

The outer periphery of said end portion of the cartridge may be frusto-conical for engagement with a complementary frusto-conical seating surface provided in said chamber provided in the body of the pump.

In such constructions, the peristaltic pump may be substantially as described in British Patent Specification No. 1,578,022, and particularly with reference to FIGS. 7 and 8 of that Specification, wherein a cartridge embodying the present invention is releasably engaged with that pump in place of a cartridge comprising a housing containing a single flexible walled tube as described in that British Patent Specification. In such constructions, a cartridge Patent Specification. In such constructions, a cartridge embodying the invention may be provided with a peripheral shoulder to be engaged by a pair of locking pins provided on opposite sides of said chamber of the peristaltic pump substantially as described in British Patent Specification No. 1,578,022 and corresponding U.S. Pat. No. 4,178,138, the disclosures in which are included herein by reference.

BRIEF DESCRIPTION OF THE DRAWINGS

FIGS. 3A and 3B are respectively an end view and a side view of the cartridge;

FIG. 4 is a side view of the cartridge in its open position;

FIG. 5 is a diagrammatic side view illustrating the elements of the cartridge;

FIG. 6 is an underplan view of the track carrier of the cartridge;

DETAILED DESCRIPTION

Figure 1:
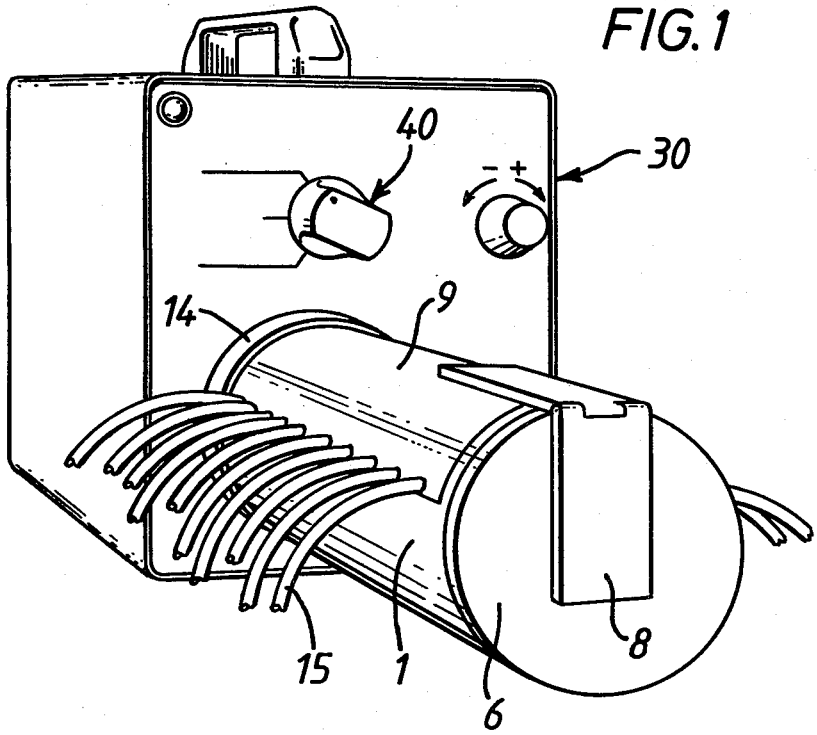
FIG. 1 is a perspective view of a peristaltic pump fitted with a multi-tube cartridge embodying the invention.
Figure 2:
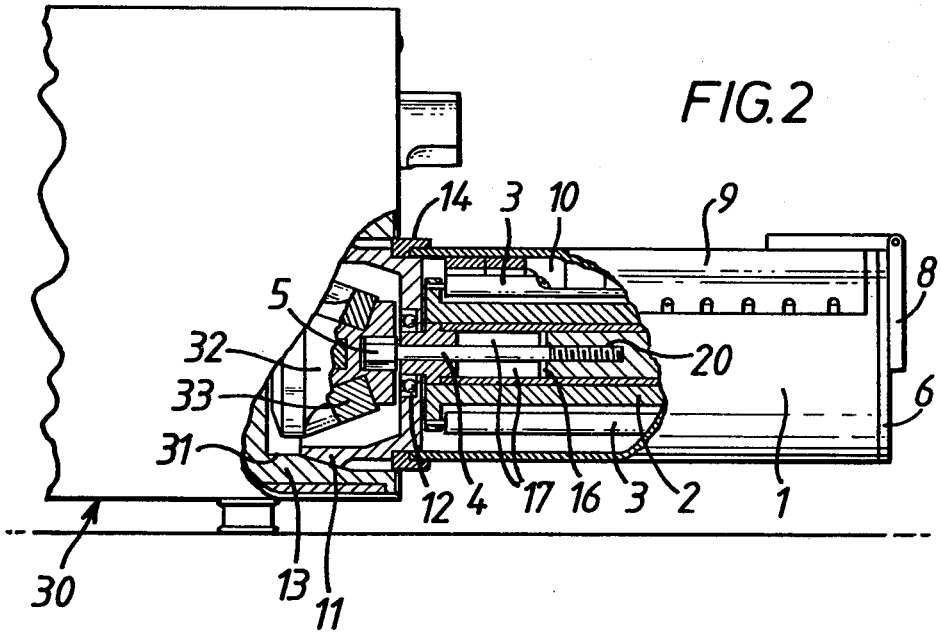
FIG. 2 is a side view partly in section of the pump and cartridge of FIG. 1.

Referring to the drawings, a peristaltic pump (30) comprises a main housing having a circular socket (31) in which a multi-tube cartridge (1) is releasably mounted. The pump has an electric drive motor having an output shaft which drives a rotary assembly (32) located in the socket. The rotary assembly has a pair of rollers (33) rotatably mounted at opposite locations on the periphery of the assembly (32) such that the axes of the rollers converge towards the open end of the socket. A hexagonal recess is provided in the free end face of the rotary assembly (32) for a purpose described below. This pump may be similar to those described in British Patent Specification No. 1,578,022 to which reference should be made for fuller details. In that specification a cartridge having a single flexible walled tube can be releasably located in the socket in the pump housing for cooperation with the pump rotary assembly therein to effect pumping of fluid through the tube.

In the present illustrative embodiment of the invention a multi-tube cartridge is releasably secured in the socket in the pump housing. The cartridge comprises a tubular housing (1) made of aluminium and having a rotatable member supported therein. The rotatable member comprises a carrier (2) for six freely rotatable rollers (3). The roller carrier is driven in a clockwise direction by means of a spring biased retractable shaft (4) having at one end a hexagonal shaped portion (5) for engagement in the hexagonal recess provided centrally in the free end face of the rotary assembly (32) of the pump. The tubular housing (1) has at one end an endplate (6). As illustrated in FIG. 5, a ballrace (7) is mounted centrally within the endplate (6) for the purpose of supporting one end of the roller carrier (2).

Figure 7:
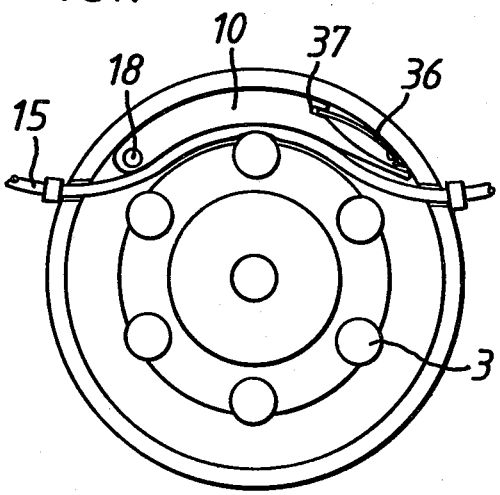
FIG. 7 is a diagrammatic view of the rotor and encircling housing of the cartridge illustrating the positioning therein of a flexible fluid delivery tube.
Figure 8:
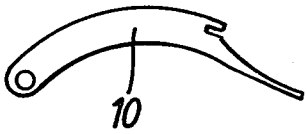
FIG. 8 is a side view of a track element of the track carrier of FIG. 6.

The tubular member (1) has an arcuate wall portion fixed by a hinge (8) to a portion of the tubular housing and providing a support (9) for ten spring-biased curved track elements (10) (as illustrated in FIGS. 7 and 8). The tubular housing (1) also has an aluminium nose portion (11) for locating and holding centrally a ballrace (12) which supports the other end of the roller carrier (2) as illustrated in FIG. 5. The nose portion (11) has a tubular wall having an external frusto-conical end portion for locating the cartridge concentrically in the socket (13) of the pump housing by engagement with a corresponding frusto-conical seating surface therein. A curved shoulder is formed on the outer periphery of the tubular wall of the nose portion (11) adjacent to its frusto-conical portion for cooperation with locking rollers or pins provided in the pump housing in order to lock the nose portion (11) in the pump housing socket. The locking rollers or pins may for example be provided in the pump housing as described and illustrated in the construction of FIGS. 7 and 8 in British Patent Specification No. 1,578,022. The locking rollers or pins are engaged or released by operation of a knob (40) on the pump housing (FIG. 1).

Ten pairs of aligned notches (35) are formed in the opposite axial edges of the arcuate track carrier (9), as shown in FIGS. 3, 4 and 6, and ten flexible plastics or silicone rubber tubes (15) are loaded thereon by engagement of the tubes in respective pairs of notches, as seen in FIG. 1. The hinged wall portion of the tube (1), namely track carrier (9) is locked into its closed position by means of a locking ring (14). The locking ring has an arcuate section cut away as seen in FIG. 4 to allow closing of the track carrier (9). The track carrier is locked in the closed position by rotating the locking ring through 180° so that its cut away section is opposite to the hinged track carrier (9) whereby the arcuate protruding section of the locking ring then overlaps the free end of the track carrier (9) as seen in FIG. 3B.

Referring to FIG. 5, a retractable drive shaft (4) for the roller carrier has a hexagonal end portion (5) and, at its opposite end, a pin (16) which extends through the shaft (4) at right angles thereto and protrudes by equal lengths either side of the shaft (4). The protruding parts of the pin locate in respective grooves (17) located on opposite sides of the bore in the hub of the roller carrier into which the spring-biased drive shaft extends thereby permitting linear movement of the shaft (4) while affording a means of transmitting to the roller carrier rotary drive applied to the hexagonal end portion (5) of the shaft (4). The drive shaft (4) is spring-biased to facilitate engagement of the hexagonal end portion in the hexagonal recess provided in the free end face of the pump rotor assembly because it allows the hexagonal end portion (5) of the shaft to protrude axially beyond the end of the nose portion (11) of the cartridge as seen in FIGS. 3, 4, and 5. When the nose portion of the cartridge is located in the socket in the pump housing, the shaft (4) is telescoped into the axial bore in the hub of the roller carrier (2) thereby compressing the spring (20).

With the cartridge locked in the pump housing socket with ten tubes (15) located in the track carrier (9) and the track carrier locked in its closed position by locking ring (14), as shown in FIG. 1, pumping can commence by actuation of the electric motor of the pump. The six freely rotatable rollers (3) on the roller carrier (2), which is rotated by the drive from the rotary assembly (32) of the pump transmitted by the shaft (4), act to occlude the ten flexible plastics or silicone rubber tubes by compressing them against the ten spring-biased curved tracks (10) respectively, thereby inducing pressure in front of, and a partial vacuum behind, the moving rollers (3). The arcuate length of each curved track is such that there is always at least one roller occluding the respective tube at any time so as to maintain a continuous flow of the liquid being pumped therethrough. The ten curved tracks (10) are pivotally supported by a rod (18) the ends of which are fixed in respective brackets supported on the underside of the track carrier (9) one at each end thereof and which extends through an aperture in a further centrally located bracket. Each pivotally mounted track member is provided with an associated leaf spring (36) which is fixed at one end to the underside of the track carrier (2) and engages at its other end in a slot (37) provided in a free end face of the corresponding track member (10) whereby the track members are biased towards the rollers (3) and can act to compensate for any variations in the wall thickness of the flexible tubes.

Advantages of the above described cartridge include the provision of a device whereby a plurality of tubes of different bore sizes but approximately the same wall thickness can be handled simultaneously to achieve pumping of fluid therethrough by peristaltic action. Moreover, the tubes, except for their connecting ends, are totally enclosed. Furthermore, the spring-biased curved tracks compensate for slight variations in the tube wall thicknesses. Also the cartridge is driven and the speed of rotation of the occluding rollers is controlled by the parent peristaltic pumping machine in which the cartridge is fitted and is operated from the parent machine. The cartridge is also adapted so that it can be locked into the parent machine by means of the locking facility provided on the parent machine. Furthermore the spring-loaded protruding drive shaft of the cartridge provides a simple and effective drive transmission device between the parent machine and the cartridge is readily engaged therebetween when the cartridge is loaded in the parent machine.

I claim:

1. In a peristaltic pumping device comprising a housing, rotor means rotatably mounted in the housing, means for locating a plurality of flexible walled tubes to extend around the rotor means at respective positions axially along the rotor means such that the rotor means, when rotated in use, act on the tubes to compress successive parts thereof against support means provided on the housing thereby inducing a flow of fluid through the tubes by peristaltic action; the improvement wherein:

said support means comprise a plurality of individual curved track members each separately, pivotally mounted on the housing at or adjacent one end thereof with resilient means being provided to act between the housing and each track member at a position spaced from the pivotal mounting thereof.

2. A pumping device as claimed in claim 1 wherein said locating means are adapted to locate a plurality of tubes, in use, such that they extend only part way around the rotor means.

3. A pumping device as claimed in claim 1 wherein the rotor means comprise a plurality of circumferentially spaced members arranged so that, in use, at least one such member is in engagement with each tube at any angular position of the rotor means.

4. A pumping device as claimed in claim 3 wherein the rotor means comprise a plurality of freely rotatable rollers arranged in an annular series which is coaxial with the axis of rotation of the rotor means, for engagement with a plurality of tubes located in use in the housing.

5. A pumping device as claimed in claim 1 wherein said locating means comprise a wall portion of the housing which is moveably mounted thereon to allow positioning of said plurality of tubes in the device and locking means to lock the wall portion in its closed position in the housing wall.

6. A pumping device as claimed in claim 5 wherein the housing comprises a tubular wall surrounding the rotor means, said wall portion being an arcuate section of that tubular wall.

7. A pumping device as claimed in claim 6 wherein the arcuate wall portion is hingedly mounted on the housing at one axial end of the arcuate wall portion.

8. A pumping device as claimed in claim 7 wherein said locking means comprise a ring rotatably mounted on the housing and having an arcuate axially projecting flange adapted to overlie a portion of said arcuate wall portion at the opposite axial end thereof to said one axial end in particular angular positions of the ring thereby to lock the wall portion in its closed position in the housing wall.

9. A pumping device as claimed in claim 6 wherein said arcuate wall portion is provided with pairs of aligned notches in its axial edges at spaced locations therealong whereby said plurality of flexible walled tubes can be engaged in respective pairs of notches with the wall portion in an open position whereby the tubes are brought into engagement with the rotor means when the wall portion is moved into its closed position.

10. A pumping device as claimed in claim 6 wherein said support means are mounted on the inner surface of the arcuate wall portion.

11. A pumping device as claimed in claim 10 wherein the track members are resiliently mounted on said wall portion to accommodate flexible walled tubes of different bore sizes.

12. A pumping device as claimed in claim 1 combined with a drive means for rotating said rotor means.

13. A pumping device as claimed in claim 1 which is in the form of a cartridge adapted to be releasably engaged with a separate rotary drive means incorporating a prime mover.

14. A pumping device as claimed in claim 13 in combination with a peristaltic pump comprising a body having an open mounted chamber, a rotary member mounted in the body for rotation in the chamber about an axis, and means for releasably mounting said cartridge in the chamber through the open mouth thereof so that the rotary member, in use, cooperates with the rotor means of the cartridge to transmit rotary drive thereto.

15. A pumping device as claimed in claim 13 in which the cartridge is adapted to cooperate with a peristaltic pump comprising a body having an open mouthed chamber, and a driven rotary device mounted in the body for rotation in the chamber about an axis wherein an end portion of the cartridge is adapted to be releasably mounted in the chamber through the open mouth thereof and releasable drive coupling means are provided to form a rotary drive connection between said rotor means and said rotary device on engagement of said end portion of the cartridge in said chamber.

16. A pumping device as claimed in claim 15 wherein said rotary drive connection includes a shaft projecting axially from the rotor means and fixed against rotation with respect thereto, the shaft having a head portion adapted to engage in a recess in an end face of the rotary device and the head portion and the recess being shaped to form a rotary drive connection therebetween.

17. A pumping device as claimed in claim 16 wherein said shaft is slideably mounted in a bore in the rotor means for linear movement relative thereto.

18. A pumping device as claimed in claim 17 wherein said shaft is resiliently biased to a position in which it projects axially beyond the end of the cartridge to facilitate engagement of said head portion in said recess.

19. A pumping device as claimed in claim 14 wherein the outer periphery of said end portion of the cartridge is frusto-conical for engagement with a complementary frusto-conical seating surface provided in said chamber provided in the body of the pump.

* * * * *